US005782364A

United States Patent [19]

Macenka

[11] Patent Number: 5,782,364

[45] Date of Patent: Jul. 21, 1998

[54] DEVICE FOR SEPARATING A MIXTURE OF OBJECTS

[75] Inventor: Heimo Macenka, Gleisdorf, Austria

[73] Assignee: Binder + Co. Aktiengesellschaft, Gleisdorf, Austria

[21] Appl. No.: 565,680

[22] Filed: Nov. 30, 1995

[30] Foreign Application Priority Data

Dec. 27, 1994 [AT] Austria ..... 2413/94

[51] Int. Cl.[6] ..... B07C 5/00

[52] U.S. Cl. ..... 209/643; 209/644; 209/905; 209/919; 209/925; 209/932

[58] Field of Search ..... 209/479, 480, 209/502, 644, 643, 691, 692, 693, 707, 905, 906, 919, 925, 932

[56] References Cited

U.S. PATENT DOCUMENTS

| | | | |
|---|---|---|---|
| 4,755,284 | 7/1988 | Brooks et al. | 209/502 X |
| 4,946,046 | 8/1990 | Affleck et al. | 209/580 |
| 5,199,575 | 4/1993 | McHugh | 209/692 X |
| 5,240,118 | 8/1993 | Mayer | 209/644 X |
| 5,375,720 | 12/1994 | Piggott et al. | 209/502 X |
| 5,382,370 | 1/1995 | Jones et al. | 209/502 X |
| 5,590,791 | 1/1997 | Gschweitl | 209/644 X |

FOREIGN PATENT DOCUMENTS

| | | | |
|---|---|---|---|
| 0 614 706 | 9/1994 | European Pat. Off. . | |
| 2 589 371 | 5/1987 | France . | |
| 28 03 684 | 8/1978 | Germany . | |
| 1577886 | 7/1990 | U.S.S.R. | 209/502 |

*Primary Examiner*—William E. Terrell
*Assistant Examiner*—Tuan N. Nguyen
*Attorney, Agent, or Firm*—Collard & Roe, P.C.

[57] ABSTRACT

Device for separating a mixture of objects of flat dimension and objects of spatial dimension with a conveying device comprising at least one conveying carrier. The conveying device comprises two boundaries to which tangents proceeding in the conveying direction may be joined, and a feeding device for feeding a stream of objects to be separated to the conveying device substantially in one layer. In order to allow a reliable separation of foils and bodies of spatial dimension, it is provided that the conveying carrier is penetrable by air or that gaps for the passing through of air are provided between the conveying carriers. A surface tangent to the upper side of the conveying carrier(s) defines a line of intersection with a plane standing rectangularly to the conveying direction, which line forms an angle with the horizontal. A casing connected to a source of underpressure for the drawing in of air through the gaps between the conveying carriers or through the conveying carrier respectively is arranged below the conveying carrier(s) in an area following the feeding area in the conveying direction, the edges of this casing substantially being sealed to the bottom side of the conveying carrier(s).

9 Claims, 2 Drawing Sheets

DEVICE FOR SEPARATING A MIXTURE OF OBJECTS

FIELD OF THE INVENTION

The invention relates to a device for separating a mixture of two-dimensional objects and three-dimensional objects, with a conveying device comprising at least one conveying carrier, which conveying device has tow boundaries arranged to be contacted by tangents extending in a conveying direction, and a feeding device for feeding a stream of the objects to be separated to the conveying device substantially in one layer.

Such a separating device is known, as an example, from the DE-OS 28 03 684 for the separation of crushed home refuse. In this known device, jolting plates arranged side by side are provided which are movable in phase opposition by means of a crankshaft. Therewith, a selectivity capacity results from the physical properties of the parts of the mixture of different objects, depending on whether they are flexible, such as foils, paper and the like, or rather rigid, such as bottles and other bodies of spatial dimension.

With this known device, the disadvantage arises on the one hand that relatively large masses have to be accelerated, decelerated and again accelerated in the opposite direction, resulting in an accordingly high energy consumption and strong wear. Additionally, the pretreatment of the feed material, for example the crushing of it, is necessary. In addition, the separating capacity of such a device is rather low, and its operation results in very strong noise generation.

Furthermore, a device is known from the EP-A1-614 706 for the separation of granular material with different grain sizes, featuring jolting plates arranged one after another which can be set into out-of phase oscillating motion.

A such known device is suited solely for the sorting of granular material according to varying grain sizes, and substantially the same disadvantages occur with this device as with the device described above, such as high energy consumption and noise generation, and furthermore very high overall dimensions.

SUMMARY OF THE INVENTION

It is the object of the present invention to avoid these disadvantages and to propose a device of the kind mentioned above, which makes possible in a straightforward manner the reliable separation of objects of substantially flat dimension from those of substantially spatial dimension, and which device distinguishes itself through low energy consumption and calm operation.

According to the invention, this is accomplished in a device as mentioned above through the characterizing features of claim 1.

Through the proposed measures, it is ensured that in the area following the feeding area, the objects of substantially flat dimension are held on the conveying carrier, or the conveying carriers respectively, and fed in the conveying direction through the suction implied by the vaccuum source, whereas the objects of spatial dimension, such as bottles and the like, slide off the conveying carrier, or the conveying carriers respectively, owing to gravitation despite the low contact pressure arising from the vacuum source. By this means, a very reliable separation of foils and bottles and the like is ensured.

Through the features of claim 2 it is ensured that the foils stick securely to the surface of the conveying carrier through the suction of the vacuum source before reaching the discharging area for the objects of spatial dimension, thereby enhancing the reliability of the separation.

Through the features of claim 3, the foils and the like to be sorted out can be detached from the conveying carrier in a very straightforward manner, the required overpressure for discharging the foils being very low, ensuring merely that forces resulting from a possible electrostatic charge or adhesion forces resulting from moisture are overcome.

Through the features of claim 4, a solution is provided which is very straightforward with respect to construction and which is also practical in regard to operation with minimum energy consumption.

The features of claim 5 allow a particularly compact design, the discharging of the substantially spatially defined objects thereby being supported by the centrifugal forces.

Through the features of claim 6, the advantage arises of an elongated design, the lateral tilt being adjustable according to the respective needs with relatively simple means.

Through the features of claim 7, the foils to be discharged can be collected in the area of the turning around of the conveyer belt on the discharging side.

DESCRIPTION OF THE PREFERRED EMBODIMENTS

Figure 1:
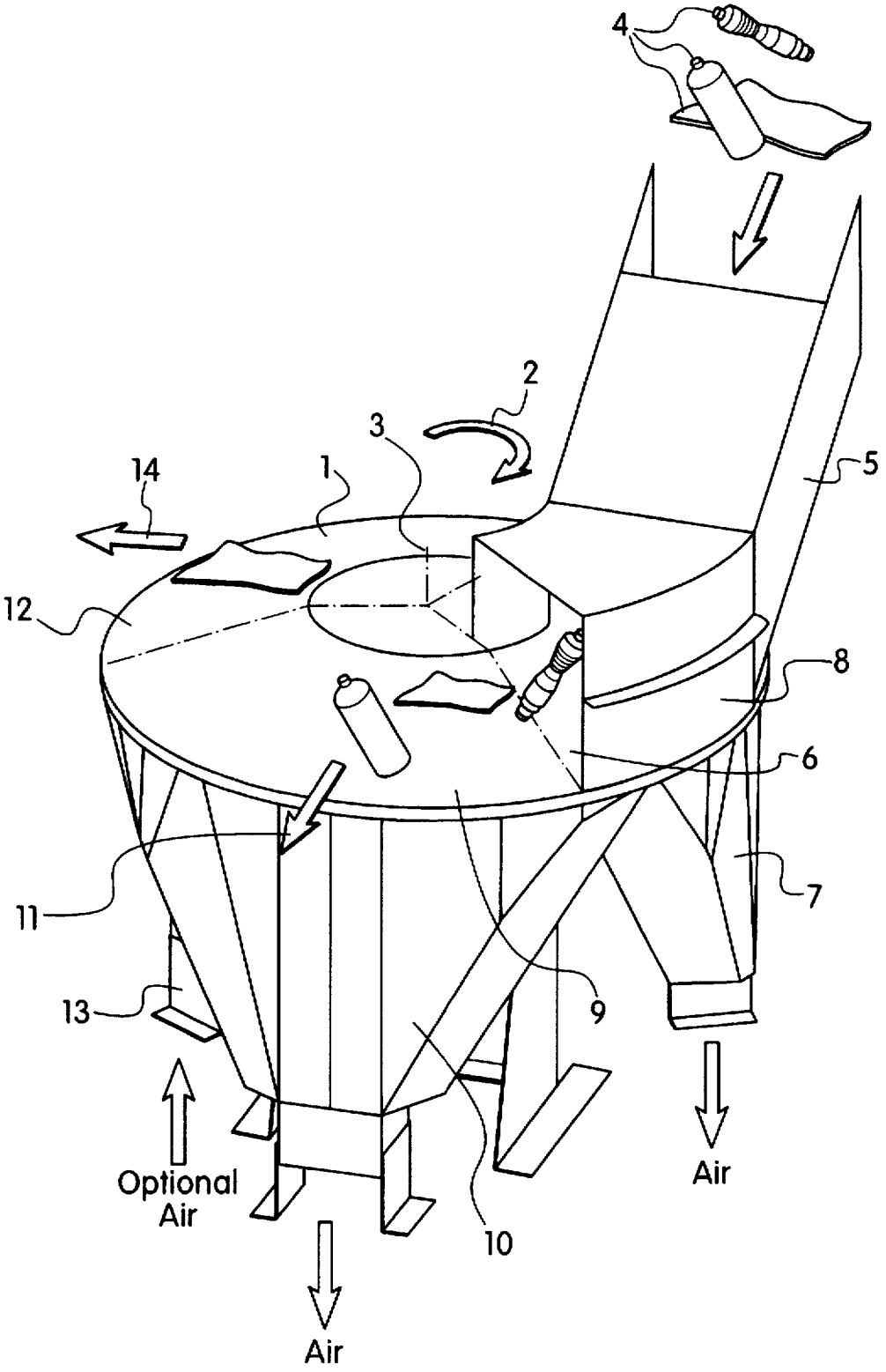
Figure 2A:
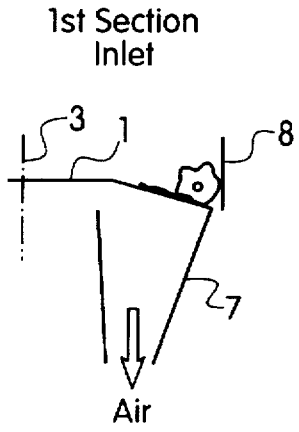
Figure 2B:
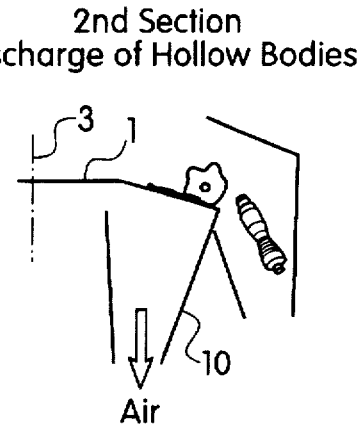
Figure 2C:
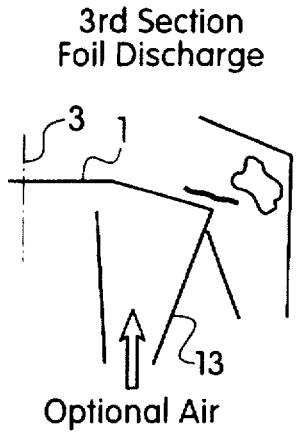
Figure 3:
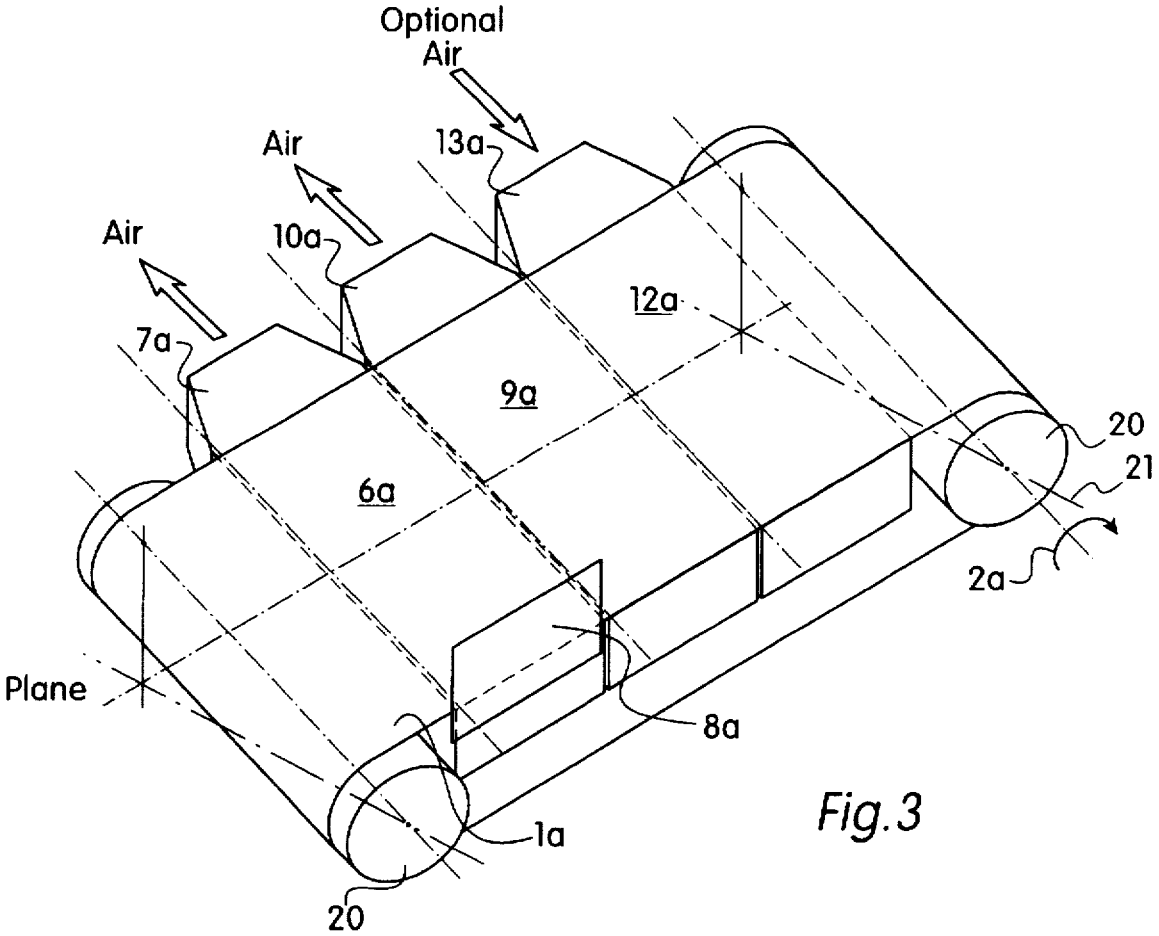

The invention will now be described in detail with reference to the drawing, in which:

FIG. 1 shows schematically a first exemplified embodiment of a device according to the invention in axonometric view;

FIG. 2*a* through 2*c* show details in different portions of the device in section;

FIG. 3 shows schematically a further exemplified embodiment of the invention.

In FIG. 1, a first embodiment of the device according to the invention is illustrated. In this embodiment, the conveying carrier is formed by a truncated cone or the surface generated by a truncated cone respectively, comprising in either case a conveying surface 1. The truncated cone or surface generated by a truncated cone respectively is perforated, allowing air to pass through the conveying surface 1 in both directions. The truncated cone or surface generated by a truncated cone respectively is pivoted and can be rotated in the conveying direction 2 through a motor not shown in the drawing. The axis of rotation 3 of the truncated cone or the surface generated by a truncated cone respectively shows a vertical slope in FIG. 1. However, it may be advantageous if the axis of rotation 3 is tilted by an angle to the vertical in a way that an area of the conveyor surface runs horizontally. Above the conveying surface 1, a feeding device 5, 8 is arranged. It comprises a prismatic casing part 5 tilted from the vertical, the side walls of this casing part tangentially approaching the circles defining the truncated cone. Curved casing walls adjoin to these side walls, the outer curved casing wall 8 serving as guiding device for the fed objects 4 to be separated.

Beneath the truncated cone or surface generated by a truncated cone respectively, fixed casings 7, 10, 13 which are open on two opposite sides are arranged, these casings being connected to one or several sources (not shown in the drawing) of underpressure and overpressure respectively. One open side of the casings 7, 10, 13 is substantially sealed to the bottom side of the truncated cone or surface generated by a truncated cone respectively. These casings 7, 10, 13 are covered by the conveying carrier 1.

The other side, lying opposite the truncated cone or surface generated by a truncated cone respectively, is connected to a blower not shown in the drawing for supplying the underpressure or overpressure respectively. The casing shows a funnel-shaped downward tapering. It is however possible to utilize a single blower which is connected on its suction side to the underpressure sources and which is connected on its pressure side via a connection line (not shown) to the overpressure source through the intermediary of a pressure regulator not illustrated in the drawing.

The casings of the sources of underpressure and overpressure 7, 10, 13 may simultaneously serve to support the whole device.

The casings 7, 10 connected to the sources of low pressure substantially cover from below the conveying surface in the area 6 of the feeding device 5, 8 as well as an area 9 succeeding the feeding device 5, 8 in the conveying direction 2. The casing 13 connected to the source of overpressure covers the conveying surface from below in an area 12 succeeding the area 9 in the conveying direction, the casings 7, 10 acted upon by the source of underpressure being distanced from the casing 13 acted upon by the source of overpressure, resulting in a neutral zone between the areas 6, 9 influenced by the underpressure and the area 12 influenced by the overpressure.

In the following, the method of operation of the device according the invention is described relating to FIG. 1 and 2.

The material 4 to be separated, which is composed of a mixture of objects of substantially flat or spatial dimension, especially foils and containers, is delivered into the feeding device 5, 8. The casing part 5 which acts as a slide feeds the objects 4 to the rotating conveying carrier 1. The objects are dragged along in the conveying direction through frictional forces on the surface of the conveying carrier 1, at the same time being subjected to suction, centrifugal and gravitational forces. A premature discharge of the objects 4, which do not yet encounter steady storage conditions in the feeding area 6, is prevented by the guiding device 8 as illustrated in FIG. 2*a*. It would also be advantageous to administer the mixture to the conveying carrier in a loosened up form. The ideal case would be delivery of the objects 4 in a single layer.

The objects 4 are pressed onto the perforated conveying carrier 1 with a force through the drawing in of air by the source of underpressure 7 below the conveying carrier. Thereby the force is proportional to the contact area between the object and the conveying carrier 1.

Objects of flat dimension such as foils and the like generally comprise a larger contact area on one hand than objects of spatial dimension such as hollow bodies and feature lower weight on the other hand.

Therefore, foils are on one hand pressed to the conveying carrier with greater force than bottles, for example, and on the other hand the gravitational and centrifugal forces acting upon them are weaker than those acting upon hollow bodies.

As soon as the objects 4 on the conveying carrier 1 leave the area 6 of the guiding device 8, the objects of spatial dimension are discharged on the inclined conveying surface in the area 9 due to gravitation, and in the embodiment according FIG. 2*b* also due to centrifugal force, as shown in FIG. 2*b*. The direction of discharge is marked with the reference symbol 11 in FIG. 1.

Objects of flat dimension continue to be held on the conveying carrier 1, la through the drawing in of air by the underpressure source 9 and reach an area 12, where they are discharged in direction 14 from the perforated conveying carrier 1 through the blowing out of air from the casing 13 acted upon by the source of overpressure. Thereby, the blowing out takes place with only slight overpressure which only has to be sufficient to overcome forces resulting from a possible electrostatic charge or adhesion forces resulting from moisture and to ensure a reliable release of the foils from the conveying carrier 1, 1*a*.

FIG. 2*c* schematically shows the discharge of the foils lifted off the conveying carrier. However, in certain cases a source of overpressure may be omitted, namely when the friction conditions allow a spontaneous sliding off of the foils or objects of flat dimension respectively. In the respective discharge areas 9, 12, collection devices not shown in detail are provided which may be funnel-shaped and penetrable by air.

FIG. 3 shows a second variant of the device according the invention. The reference symbols of the components are in accordance with FIG. 1 and 2 and are supplied with the suffix "a " for distinction. The conveying carrier 1*a* of this variant is an endless air-permeable conveyer belt wich revolves on rollers 20, the axes of the rollers 20 forming an angle with the horizontal 21 and the conveyer belt therefore featuring a lateral tilt.

The roller axes form an angle with the horizontal, resulting in the conveying surface—a plane in this case—of the conveyer belt 1*a* being tilted laterally to the conveying direction. Therefore, the upper part of the conveyer belt, the so-called upper strand, comprises a lower and a higher rim. In order to maintain the clarity of the drawing, not the whole feeding device is shown but only the guiding device 8*a*, which is arranged in the form of a panel at the lower rim of the upper strand. Below the upper strand, the sources of underpressure 7*a* and 10*a* as well as the source of overpressure 13*a* are arranged in the area 6*a*, 9*a*, 12*a* of the conveyer belt. They comprise casings with two apertures, one lying opposite to the bottom surface of the upper strand and the other aperture being connected to blowers alongside the upper rim of the upper strand.

The operating mode is analogous in accordance with the embodiment as shown in FIG. 1, with the difference that the conveyer belt does not develop centrifugal forces helping to discharge the objects.

The invention may also encompass other embodiments of the conveying device.

For example, the device according the invention may be constructed with several conveying carriers.

As an example, several conveyer rollers rotating in the same direction in a parallel arrangement could also be used for the transport of the objects to be separated. The drawing in and the blowing out respectively of air can take place through the gaps provided between the conveyer rollers.

In the same way, a conveying surface comprising several ropes or chains arranged to revolve parallel to the conveying direction could be implemented.

I claim:

1. Device for separating a mixture of two-dimensional objects and three-dimensional objects, with a conveying device comprising at least one air-permeable conveying carrier having an upper side, a plane tangentially contacting the upper side of the conveying carrier defining a line of intersection with a plane extending perpendicularly to the conveying direction, the line of intersection forming an angle with the horizontal, a feeding device for feeding a stream of the objects to be separated to the conveying device substantially in one layer, a casing connected to a source of underpressure for drawing in air through the air-permeable conveying carrier and arranged below the conveying carrier in an area following the feeding device in the conveying direction, the casing having edges substantially sealed to a bottom side of the conveying carrier.

2. Device according to claim 1, comprising a guiding device adjacent to a lower boundary of the conveying carrier and arranged between the feeding device and an adjoining end of an area covering the source of underpressure, which guiding device prevents the discharge of the objects from the conveying device.

3. Device according to claim 1, wherein the conveying carrier is constructed as a rotating truncated cone whose axis of rotation extends vertically.

4. Device according to claim 1, wherein the conveying carrier is constructed as an endless conveyor belt whose conveying direction extends horizontally and whose conveying lane is tilted.

5. Device for separating a mixture of two-dimensional objects and three-dimensional objects, with a conveying device comprising at least one air-permeable conveying carrier having an upper side, a plane tangentially contacting the upper side of the conveying carrier defining a line of intersection with a plane extending perpendicularly to the conveying direction, the line of intersection forming an angle with the horizontal, a feeding device for feeding a stream of the objects to be separated to the conveying device substantially in one layer, a casing connected to a source of underpressure for drawing in air through the air-permeable conveying carrier and arranged below the conveying carrier in an area following the feeding device in the conveying direction, the casing having edges substantially sealed to a bottom side of the conveying carrier, and another casing connected to a source of overpressure for blowing out air from below the conveying carrier and, viewed in the conveying direction, arranged in a further area at an end of the area following the feeding device, the areas acted upon by the source of underpressure and the source of overpressure being distanced from each other.

6. Device according to claim 5, wherein the casings acted upon by the source of overpressure and the source of underpressure are connected by a junction line.

7. Device according to claim 5, wherein the casing (13*a*) acted upon by the source of overpressure is arranged in an area of the end of the conveying device where the objects are discharged.

8. Device according to claim 5, wherein several casings with apertures below the conveying carrier are arranged, to each of which casings a source of underpressure or a source of overpressure is connected.

9. Device according to claim 6, further comprising a pressure regulating device containing a blower arranged in the junction line.

* * * * *